US011352030B2

(12) United States Patent
Handlin

(10) Patent No.: US 11,352,030 B2
(45) Date of Patent: Jun. 7, 2022

(54) RAILCAR SPACING TOOL

(71) Applicant: Inter-Rail Transport, Inc., Centreville, MD (US)

(72) Inventor: James E. Handlin, Hallsville, TX (US)

(73) Assignee: Inter-Rail Transport, Inc., Centreville, MD (US)

( * ) Notice: Subject to any disclaimer, the term of this patent is extended or adjusted under 35 U.S.C. 154(b) by 352 days.

(21) Appl. No.: 16/278,807

(22) Filed: Feb. 19, 2019

(65) Prior Publication Data

US 2019/0256112 A1 Aug. 22, 2019

Related U.S. Application Data

(60) Provisional application No. 62/632,042, filed on Feb. 19, 2018.

(51) Int. Cl.
*B61J 3/08* (2006.01)
*B61G 7/04* (2006.01)
*B61J 3/12* (2006.01)

(52) U.S. Cl.
CPC ..... *B61J 3/08* (2013.01); *B61G 7/04* (2013.01); *B61J 3/12* (2013.01)

(58) Field of Classification Search
CPC ..... B61J 3/08; B61J 3/12; B61J 99/00; B61J 3/00; B61G 7/04; B61G 5/00; B61G 11/00; B61D 47/00; E02D 17/08; B66F 3/24; B66F 3/28; B66F 7/04; B66F 7/08
See application file for complete search history.

(56) References Cited

U.S. PATENT DOCUMENTS

| | | | | |
|---|---|---|---|---|
| 3,793,964 | A | 2/1974 | Cheek et al. | |
| 4,038,927 | A | 8/1977 | Evans | |
| 4,080,904 | A | 3/1978 | Lofink et al. | |
| 5,176,391 | A * | 1/1993 | Schneider | B60G 17/005 180/41 |
| 5,330,308 | A * | 7/1994 | Armando | B65F 3/046 294/119.1 |
| 5,499,890 | A * | 3/1996 | Kishi | E02D 17/083 248/354.1 |
| 5,520,498 | A * | 5/1996 | DiBartolomeo | B66C 23/44 212/180 |

(Continued)

FOREIGN PATENT DOCUMENTS

| | | | |
|---|---|---|---|
| EP | 1081010 | A1 | 3/2001 |
| WO | 200136244 | A1 | 5/2001 |

*Primary Examiner* — Mark T Le
(74) *Attorney, Agent, or Firm* — Miles & Stockbridge P.C.

(57) ABSTRACT

A system and method are provided for spacing railcars of a train apart from each other with a predetermined gap in between. Embodiments include a railcar spacing tool having a hydraulic cylinder with brackets at opposing ends for contacting the frame of each of a pair of adjoined adjacent railcars to be spaced from each other, and a cylinder support frame attached to the cylinder and movably attached to a support vehicle such that the support frame is movable from a retracted position to an extended position where the brackets are between the frames of the pair of railcars. After moving the cylinder support frame to the extended position, the brackets are positioned in contact with the railcar frames, and the cylinder is engaged to create the predetermined gap between the railcars. The railcars' brakes are applied to preserve the gap, and the spacing tool is then removed.

17 Claims, 12 Drawing Sheets

(56) References Cited

U.S. PATENT DOCUMENTS

| | | | | |
|---|---|---|---|---|
| 6,508,180 | B1 | 1/2003 | Weidemann et al. | |
| 8,485,107 | B2 | 7/2013 | Heyden et al. | |
| 2011/0305529 | A1* | 12/2011 | Riggle, Jr. ..... | E02D 17/083<br>405/283 |

* cited by examiner

RAILCAR SPACING TOOL

RELATED APPLICATIONS

The present application claims priority from U.S. Provisional Application No. 62/632,042, filed Feb. 19, 2018, entitled "Railcar Spacing Tool," which is hereby incorporated by reference in its entirety.

FIELD

The present subject matter relates to tools for spacing adjacent railroad cars from each other. The present disclosure has particular applicability to tools and techniques for quickly spacing adjacent railcars from each other with a predetermined gap between them.

BACKGROUND

Railcars sometimes need to be spaced relative to each other and/or positioned relative to stationary objects with some precision in a rail yard. For example, a railcar may need to be properly positioned for tippling to unload bulk materials. Most relevant for the present disclosure, adjacent railcars must sometimes be spaced a predetermined distance from each other to receive a "bridge plate" inserted between them. The bridge plate is then used for loading and unloading cargo, such as automobiles, along the length of the train. The disclosed embodiments herein improve upon conventional railcar spacing tools and techniques.

Conventional spacing or positioning devices include those that position an entire train by pushing or chocking cars at both ends of the train, as disclosed in U.S. Pat. No. 6,508,180 and Published International Application WO 200136244. Other devices include movable wheel chocks mounted in the ground that either stop an individual car of a train at a particular place, or move a stopped car a small amount to position the car and/or the train, as disclosed in U.S. Pat. Nos. 4,038,927, 8,485,107, and 4,080,904.

Still other conventional devices disclosed in U.S. Pat. No. 4,038,927 include a carriage that rides on rails next to a train and has an arm that extends between two cars to engage the coupler. The train is then moved by motion of the carriage. Another type of conventional positioning device is disclosed in European Patent EP 1081010, wherein hydraulic or electric cylinder(s) are mounted to two adjacent cars extending between the cars, for fine positioning.

Most conventional spacing or positioning devices are not designed to reliably provide a fixed critical spacing between railcars. Those that are capable of so doing, such as disclosed in European Patent EP 1081010, are complex and expensive, requiring multiple cylinders to be permanently mounted to the railcars to be spaced. They also present a danger to workers to the extent they require workers to be positioned between railcars during the spacing process.

SUMMARY OF THE DISCLOSURE

The present disclosure provides a railcar spacing tool that addresses the aforementioned needs. The disclosed railcar spacing tool is for quickly spacing adjacent adjoined railcars from each other with a predetermined gap in between. One advantage of doing so is to enable a standard sized bridge plate to be placed over the junction between the railcars. Cargo such as automobiles can then be easily moved from one railcar to another to facilitate loading and unloading.

Embodiments include a railcar spacing tool for spacing a pair of adjacent adjoined railcars apart from each other a predetermined distance. The spacing tool comprises a cylinder having a body, a piston extendible from the body, a first bracket attached to a distal end of the body, and a second bracket attached to a distal end of the piston. The piston is extendible from the body such that a total length of the cylinder is adjustable from less than the predetermined distance to the predetermined distance, and the first and second brackets are for contacting respective frames of the adjoined adjacent railcars to be spaced from each other. When the piston is extended from the body such that the total length is less than the predetermined distance and the first and second brackets are disposed between the respective frames of the adjacent railcars, the cylinder is for extending the piston until the first and second brackets contact the respective frames of the adjoined adjacent railcars, and for further extending the piston to move the adjacent railcars relative to each other until the total length of the cylinder is the predetermined distance. The railcar spacing tool further comprises a cylinder support frame having a first end attachable to the body of the cylinder, and a second end movably attachable to a support vehicle such that the cylinder support frame is movable from a retracted position where the first end is proximal the support vehicle, to an extended position where the first and second brackets are disposed between the respective frames of the pair of adjoined adjacent railcars.

Embodiments further include a method for spacing a pair of adjacent adjoined railcars apart from each other a predetermined distance. The method comprises providing a spacing tool including a cylinder having a body, a piston extendible from the body, a first bracket attached to a distal end of the body, and a second bracket attached to a distal end of the piston. The piston is extendible from the body such that a total length of the cylinder is adjustable from less than the predetermined distance to the predetermined distance, and the first and second brackets being for contacting respective frames of the pair of adjoined adjacent railcars to be spaced from each other. The method further comprises positioning the pair of adjoined adjacent railcars such that a distance between their respective frames is less than or equal to the predetermined distance; positioning the spacing tool such that the first and second brackets are disposed between and contact the respective frames of the pair of adjoined adjacent railcars; extending the piston from the body of the cylinder as needed to move the adjacent railcars relative to each other until the total length of the cylinder is the predetermined distance, thereby spacing the respective frames of the pair of adjoined adjacent railcars from each other by the predetermined distance; applying brakes of the pair of adjoined adjacent railcars to preserve the spacing between the railcars; and removing the spacing tool from between the respective frames of the pair of adjoined adjacent railcars.

Objects and advantages of embodiments of the disclosed subject matter will become apparent from the following description when considered in conjunction with the accompanying drawings. Additionally the different configurations discussed in the sections below may be performed in a different order or simultaneously with each other.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

The disclosed railcar spacing tool is an implement that can be attached to a utility or support vehicle with hydraulic pump capabilities. Its purpose is to accurately space adjoined railroad cars apart from each other with a specified distance (e.g., 42") between them. In certain embodiments, it has a hydraulic cylinder that has a total expansion distance of 42" and mounting brackets at opposing ends of the cylinder which are placed on the frames of adjacent railcars in between the cars (i.e., at the junction between a pair of railcars).

The procedure for using the spacing tool is to position the tool's mounting brackets on the frames of two adjacent rail cars (e.g., 2' to 4' from the ground) starting on a bunched (i.e., compressed) end of a cut of cars. The spacing tool cylinder is then engaged as needed to create a desired gap between the cars, such as a maximum gap of 42." Once the proper spacing has been achieved, hand brakes on both cars involved in the spacing are fully applied before disengaging the spacing tool, to insure the proper gap is captured. The spacing tool is then removed by reversing the pressure on the hydraulic cylinder, moving it to the next junction, and repeating the process.

In certain embodiments, the cylinder is mounted on an extendable and retractable frame or boom, which is mounted to the utility/support vehicle and can be extended between adjacent rail cars to be spaced. Thus, in certain embodiments, the disclosed tool has three basic functions: 1) raise and lower the boom, 2) extend and retract the boom, and 3) spread or pull adjacent cars relative to each other using the hydraulic cylinder to achieve the desired spacing between the cars.

The use of a portable adjustable railcar spacing tool, such as the disclosed tool, for setting critical spacing between cars has several advantages over conventional spacing tools and techniques. It can be fitted to any utility or support vehicle having a hydraulic pump or capable of carrying a hydraulic pump. Its boom has the ability to extend into railcar junctions; e.g., up to five feet, improving safety by eliminating the need for workers to position themselves between railcars. The disclosed tool produces a fixed gap in the railcar junctions every time, preventing undesirable railcar carry over due to inaccurate junction spacing.

Figure 1:
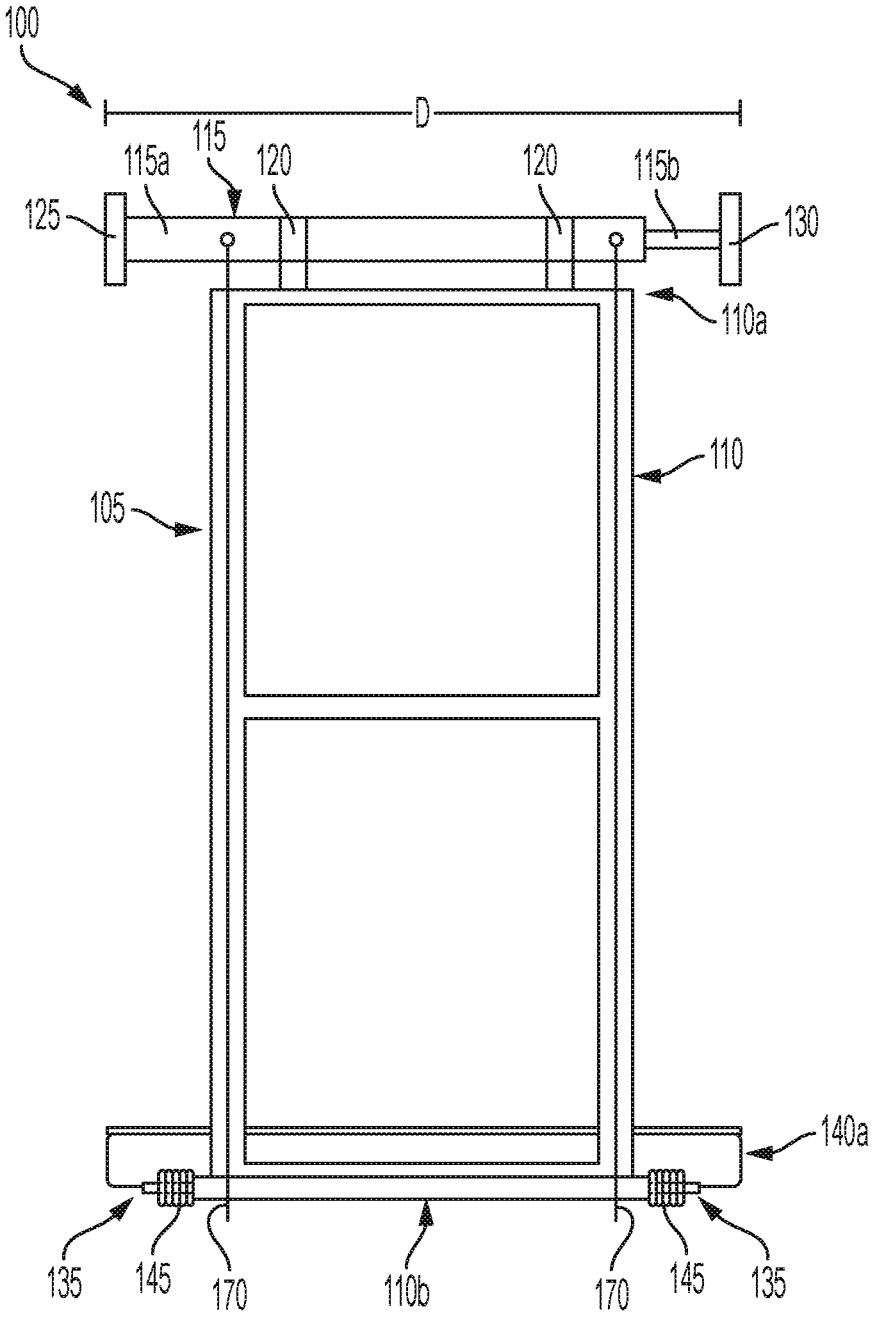
FIG. 1 is a top view of a railcar spacing tool according to an embodiment of the present disclosure.

An embodiment of the railcar spacing tool according to the present disclosure will now be described with reference to FIGS. 1-4. As shown in FIGS. 1 and 3, the spacing tool 100 includes a cylinder support frame or boom 105 having a frame 110; e.g., a welded frame comprising 2"×¼" square steel tubing about 60 inches tall and about 15 inches wide. A hydraulic cylinder 115 having a total travel of a predetermined distance D (e.g., about 42 inches including its body) is attached to a first end 110*a* of the frame 110, as by a pair of clamps 120. Cylinder 115 has a body 115*a*, a piston 115*b* extendible from the body 115*a*, a first bracket 125 attached to a distal end of the body 115*a*, and a second bracket 130 attached to a distal end of the piston 115*b*, the piston 115*b* being extendible from the body 115*a* such that a total length of the cylinder 115 is adjustable from less than the predetermined distance D to the predetermined distance D, the first and second brackets 125, 130 being for contacting respective frames 150*a* of adjoined adjacent railcars 150 to be spaced from each other. Railcars 150 are joined to each other via a pair of conventional couplers 160.

Figure 2:
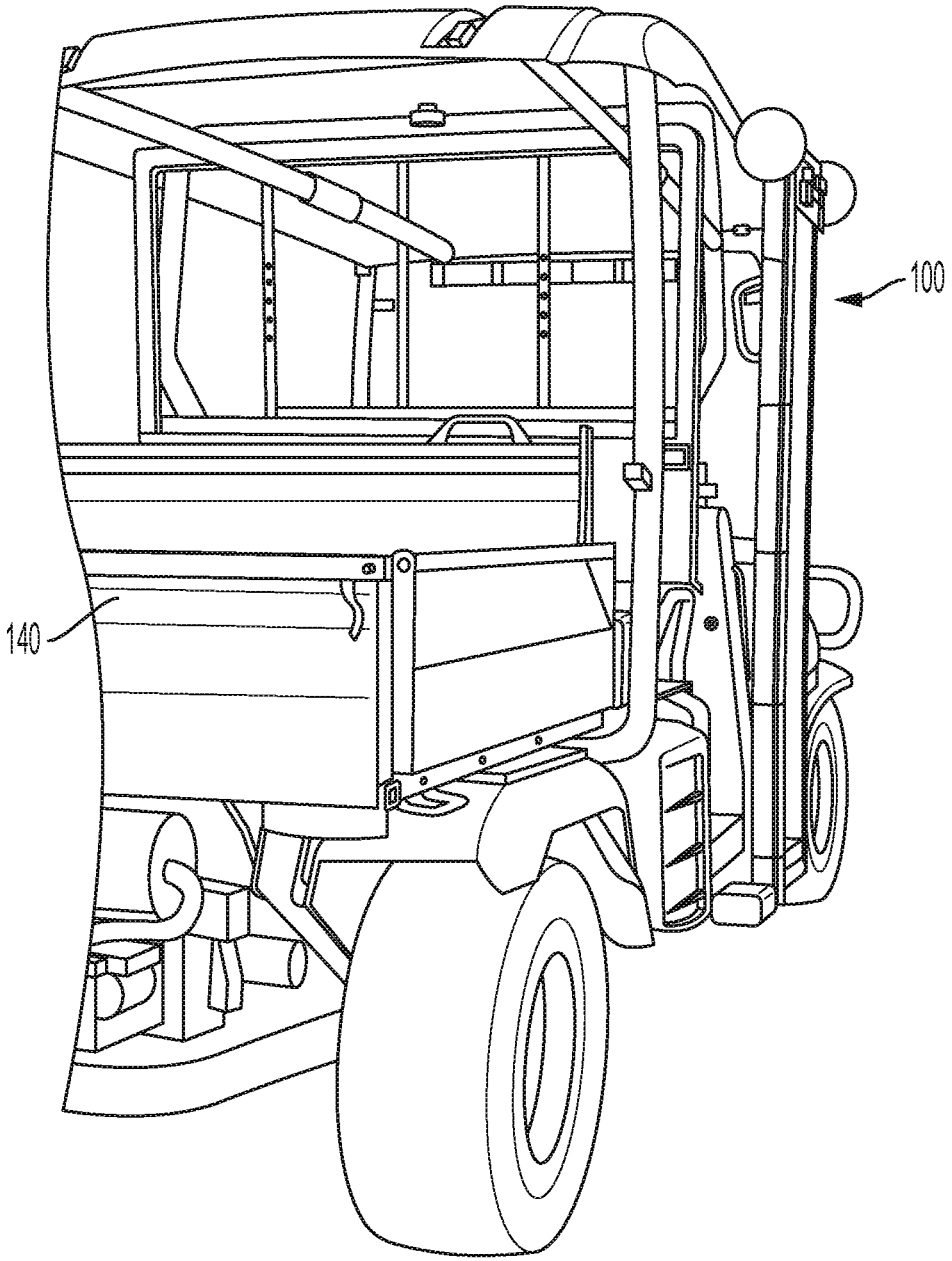
FIG. 2 is a perspective view of the railcar spacing tool of FIG. 1 attached to the frame of a utility vehicle, with its boom in the retracted (substantially vertical) position.
Figure 3:
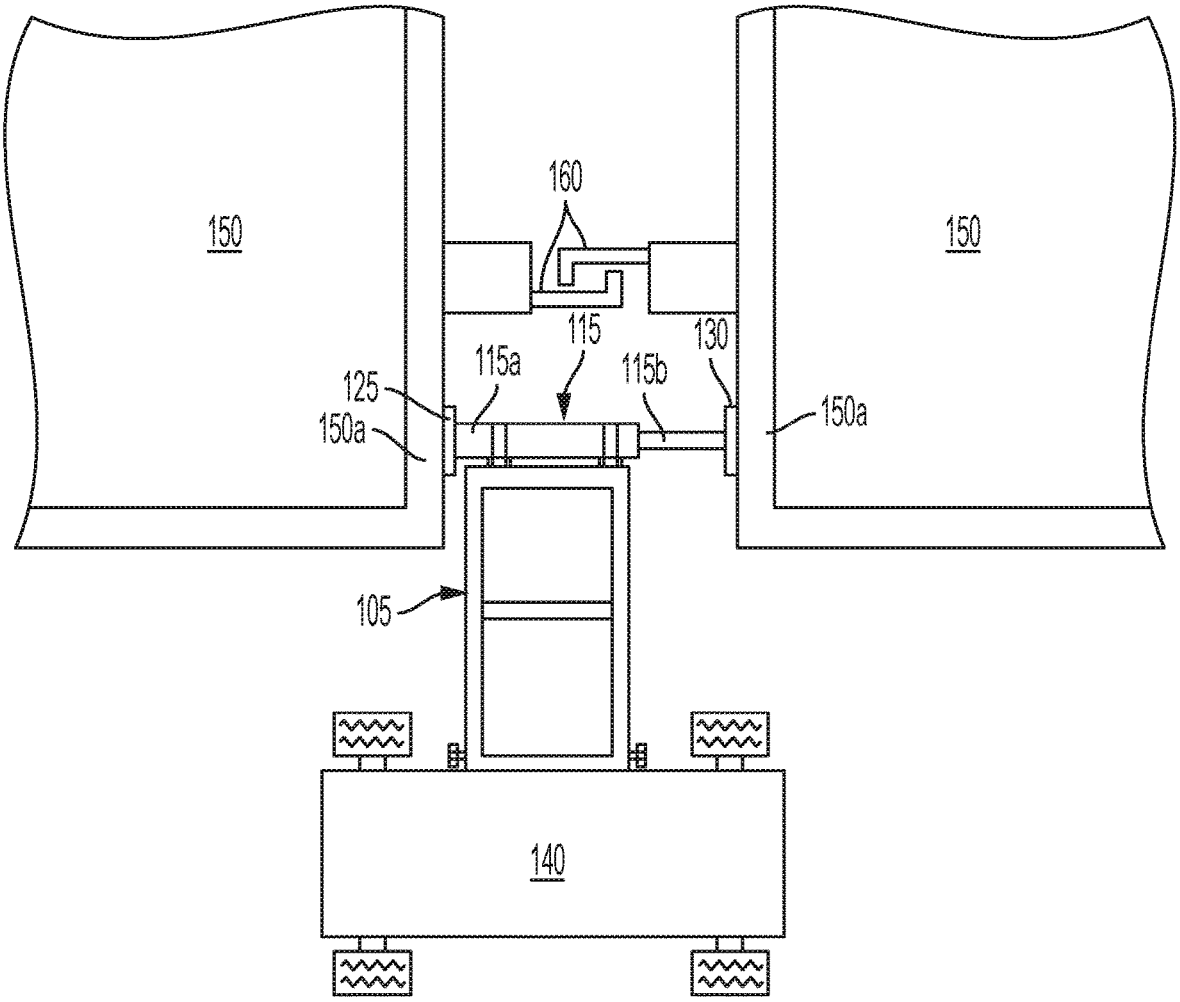
FIG. 3 is a top view of the railcar spacing tool of FIG. 1 positioned to set a predetermined gap between two railcars.
Figure 4:
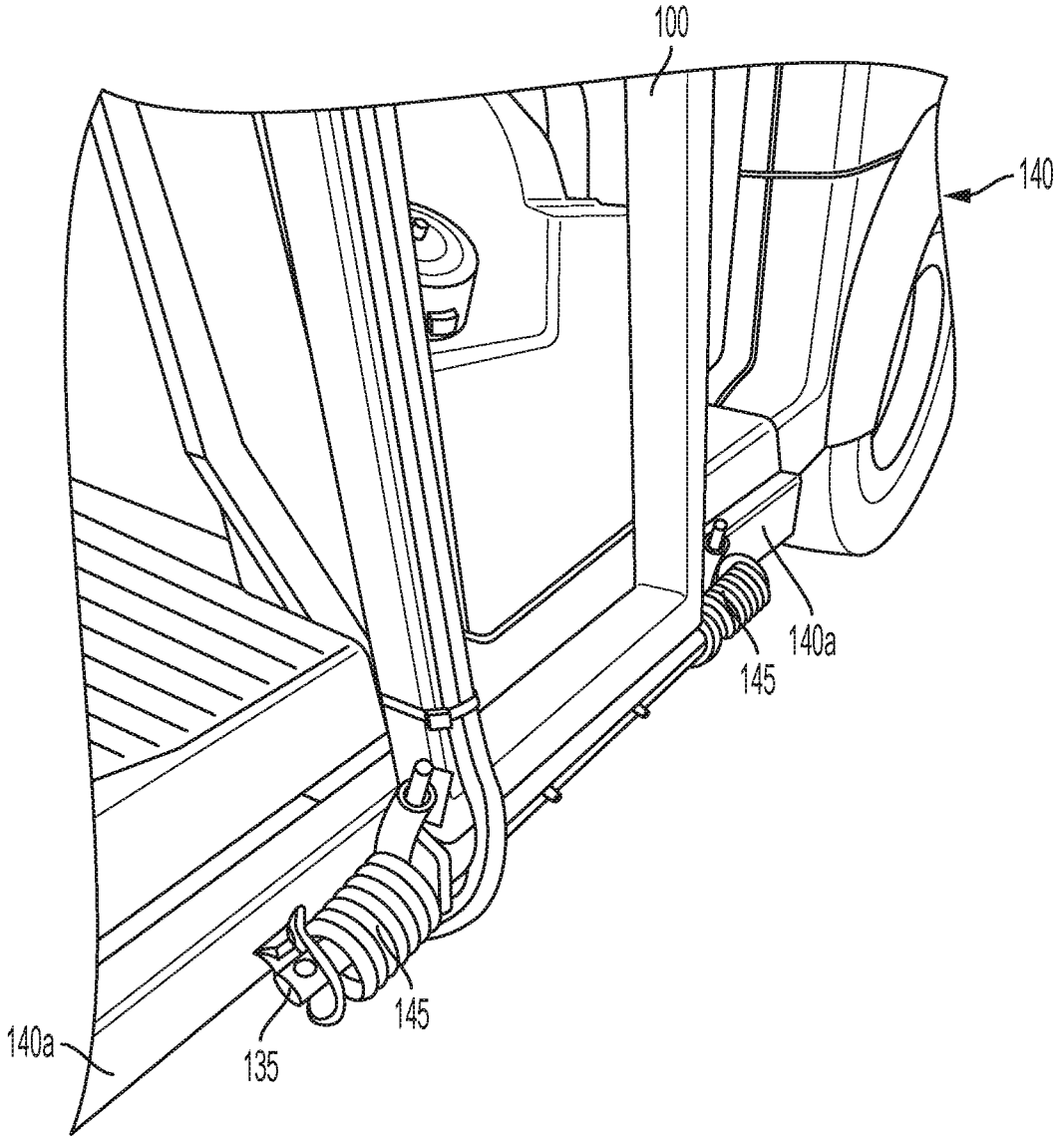
FIG. 4 is a close-up perspective view showing the bottom end of the railcar spacing tool of FIG. 1 attached to the frame of a utility vehicle.
Figure 5:
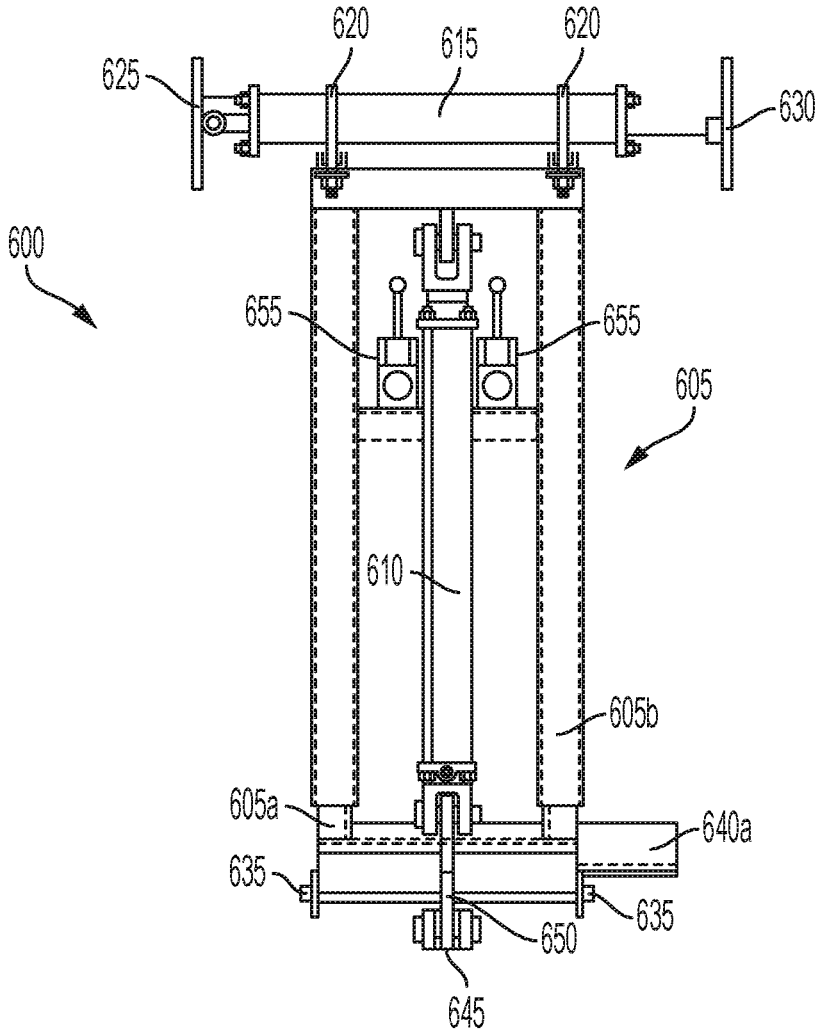
FIGS. 5-8 are front, left, back, and right side views, respectively, of an alternative embodiment of a railcar spacing tool according to the present disclosure, with its boom in the retracted (substantially vertical) position.
Figure 6:
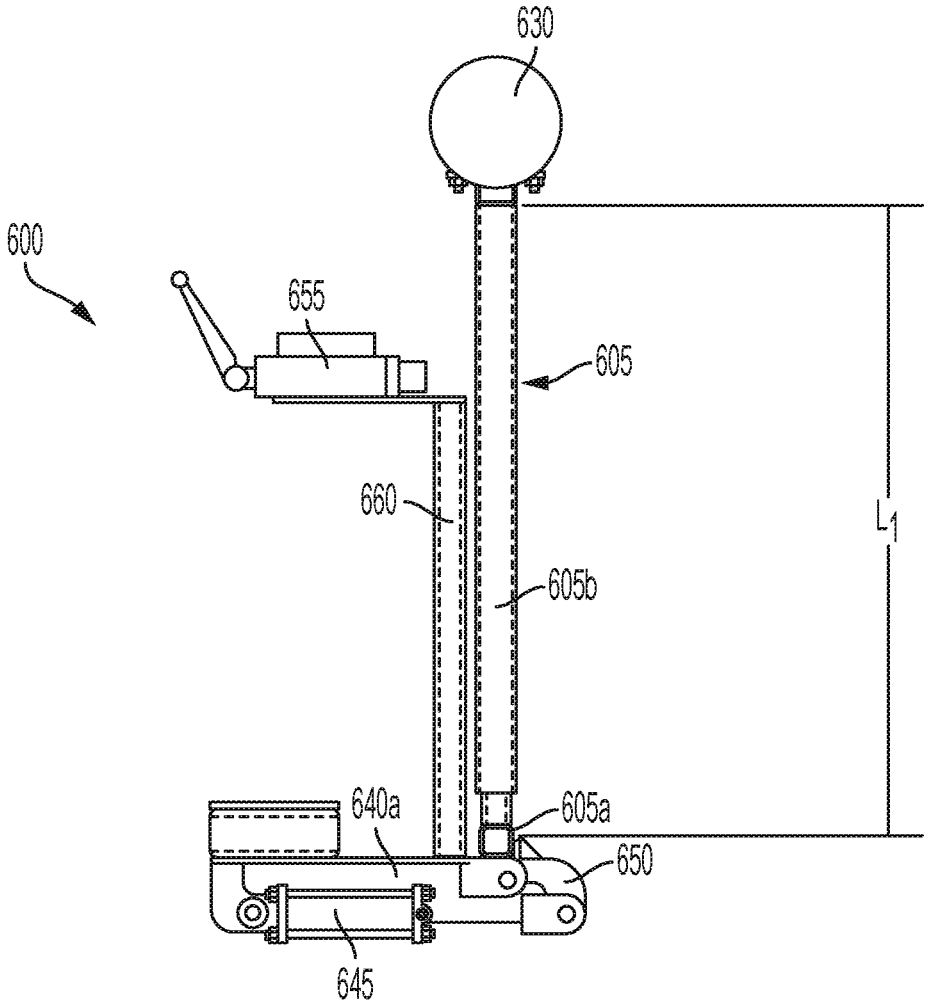
Figure 7:
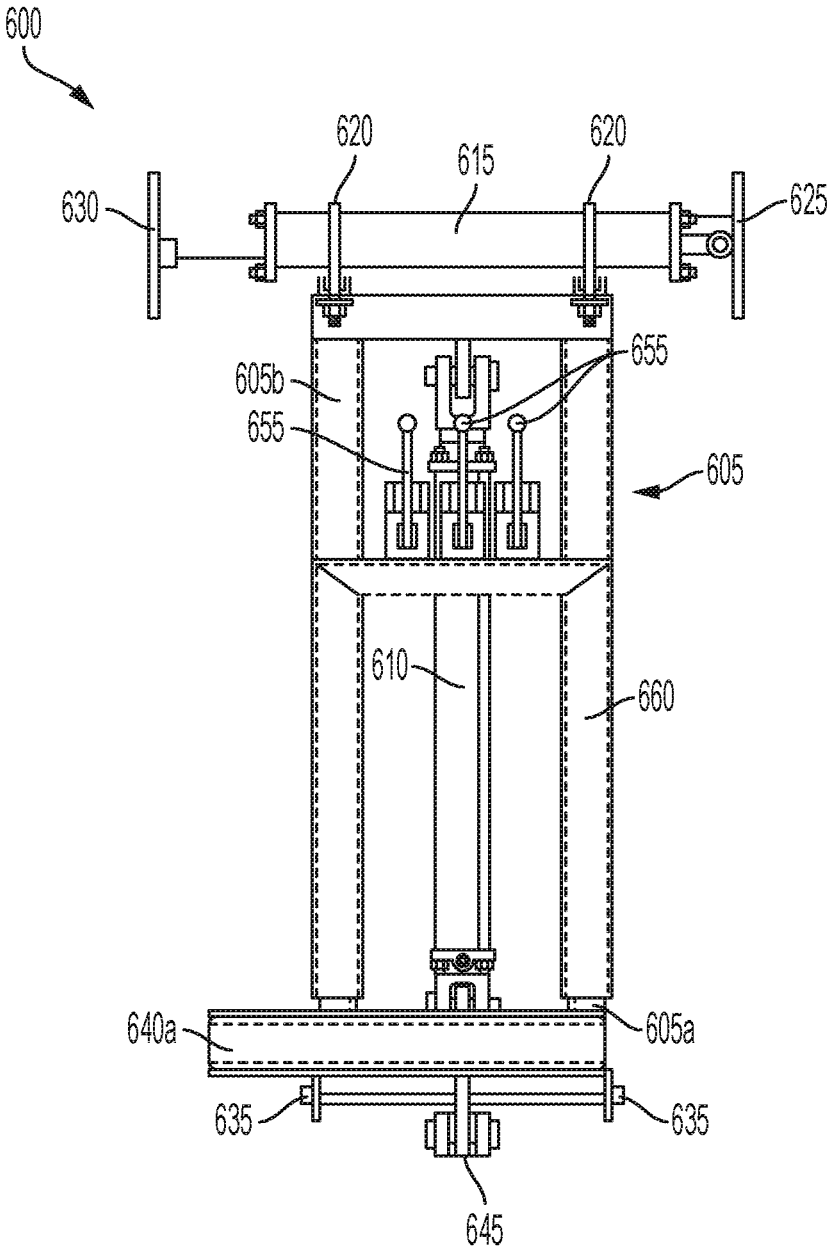
Figure 8:
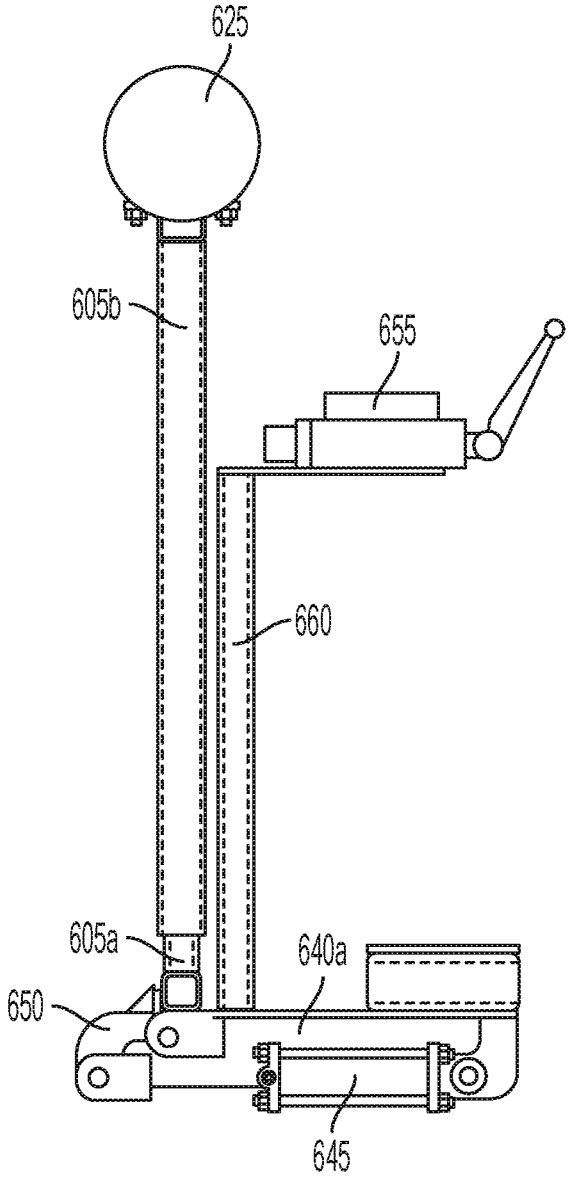
Figure 9:
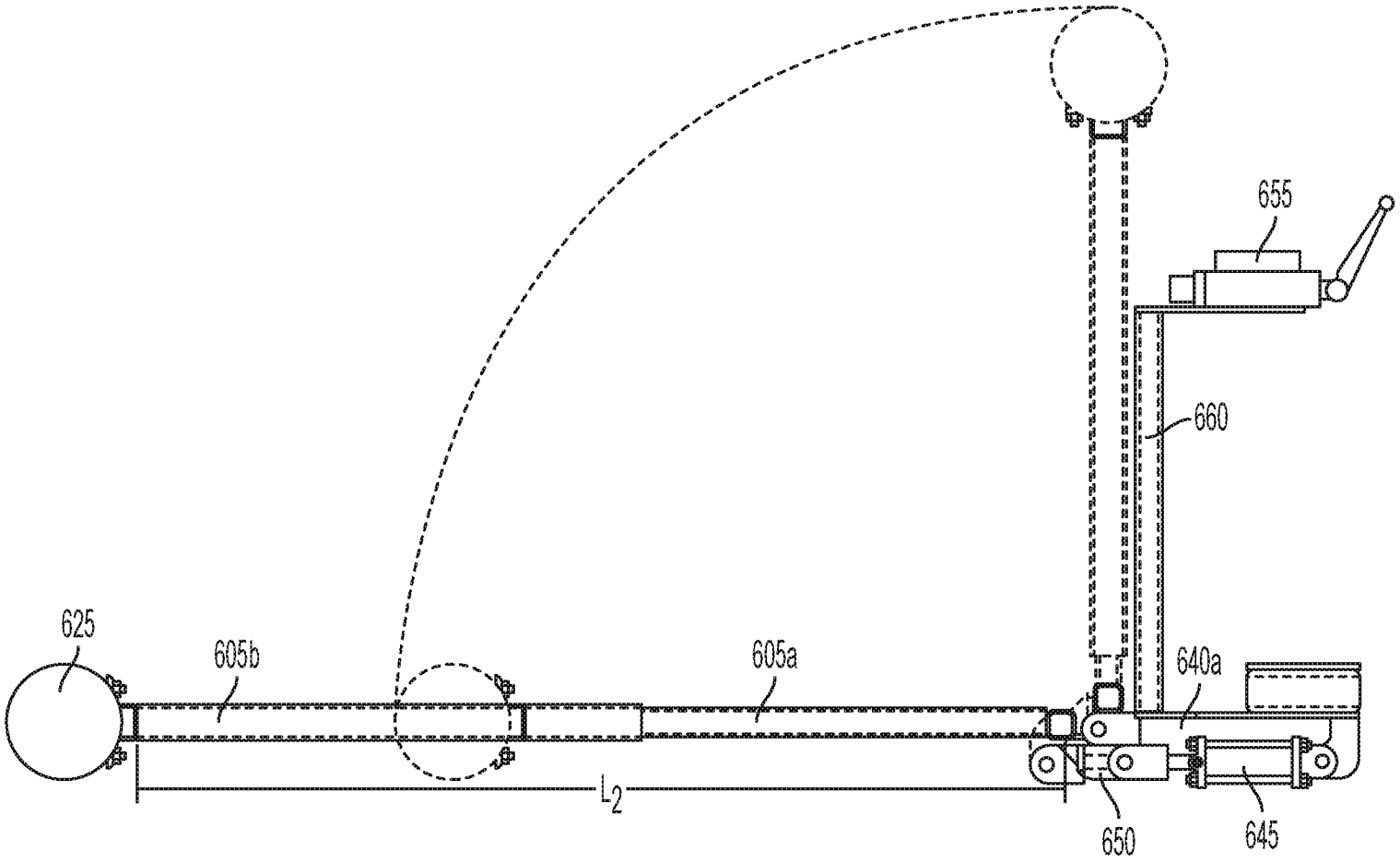
FIG. 9 is a right side view of the spacing tool of FIGS. 5-8 with its boom in the extended (substantially horizontal) position.

An opposing second end 110*b* of the frame 110 has a pair of pins 135 for attaching the boom 105 to the chassis frame 140*a* of a conventional utility or service vehicle 140, such as available from Kubota Tractor Corporation, as shown in FIGS. 2 and 4. As best seen in FIG. 4, the boom 105 is attached to the chassis 140*a* of the utility vehicle 140 via the pins 135 and a conventional spring lift mechanism having springs 145, for easy management of the tool. The cylinder support frame 110 is movable from a substantially vertical retracted position, as shown in FIGS. 2 and 4, where the first end 110*a* is proximal the support vehicle 140, to a substantially horizontal extended position as shown in FIG. 3, where the first and second brackets 125, 130 are disposed between the respective frames of the pair of adjoined adjacent railcars.

A conventional hydraulic pump (not shown) is carried by the utility vehicle 140 and connected to the hydraulic cylinder 115 by conventional lines or hoses 170 and control valves to operate the cylinder 115 in a conventional manner. In operation, when the piston 115*b* is extended from the body 115*a* such that the total length is less than the predetermined distance D and the first and second brackets 125, 130 are disposed between the respective frames 150*a* of the adjacent railcars 150, the cylinder 115 is for extending the piston 115*b* until the first and second brackets 125, 130 contact the respective frames 150*a* of the adjoined adjacent railcars, and for further extending the piston 115*b* to move the adjacent railcars 150 relative to each other until the total length of the cylinder 115 is the predetermined distance D.

A further embodiment of the railcar spacing tool according to the present disclosure will now be described with reference to FIGS. 5-10. The spacing tool 600 of this embodiment includes a cylinder support frame including a telescoping boom 605 having an inner frame 605*a* and an outer frame 605*b* that slides over the inner frame 605*a*. Inner and outer frames 605*a*, 605*b* each comprise; e.g., welded square steel tubing. In certain embodiments the outer frame 605*b* is about 60 inches tall and about 15 inches wide. A hydraulic cylinder 610 is operatively connected between the inner and outer frames 605*a*, 605*b* to cause the outer frame 605*b* to slide over the inner frame 605*a* to adjust the overall length of the boom 605.

Another hydraulic cylinder 615, which in some embodiments is identical to cylinder 115 of the embodiment of FIG. 1 described herein above (e.g., having a total travel of about 42 inches including its body), is attached to a free end of the outer frame 605*b*, as by a pair of clamps 620. A pair of brackets 625, 630 is attached to respective ends of hydraulic cylinder 615, for contacting respective frames of adjacent railcars to be spaced from each other. Hydraulic cylinder 615 thus performs the same function, in the same way, as cylinder 115 of the embodiment of FIG. 1 described herein above.

Figure 10:
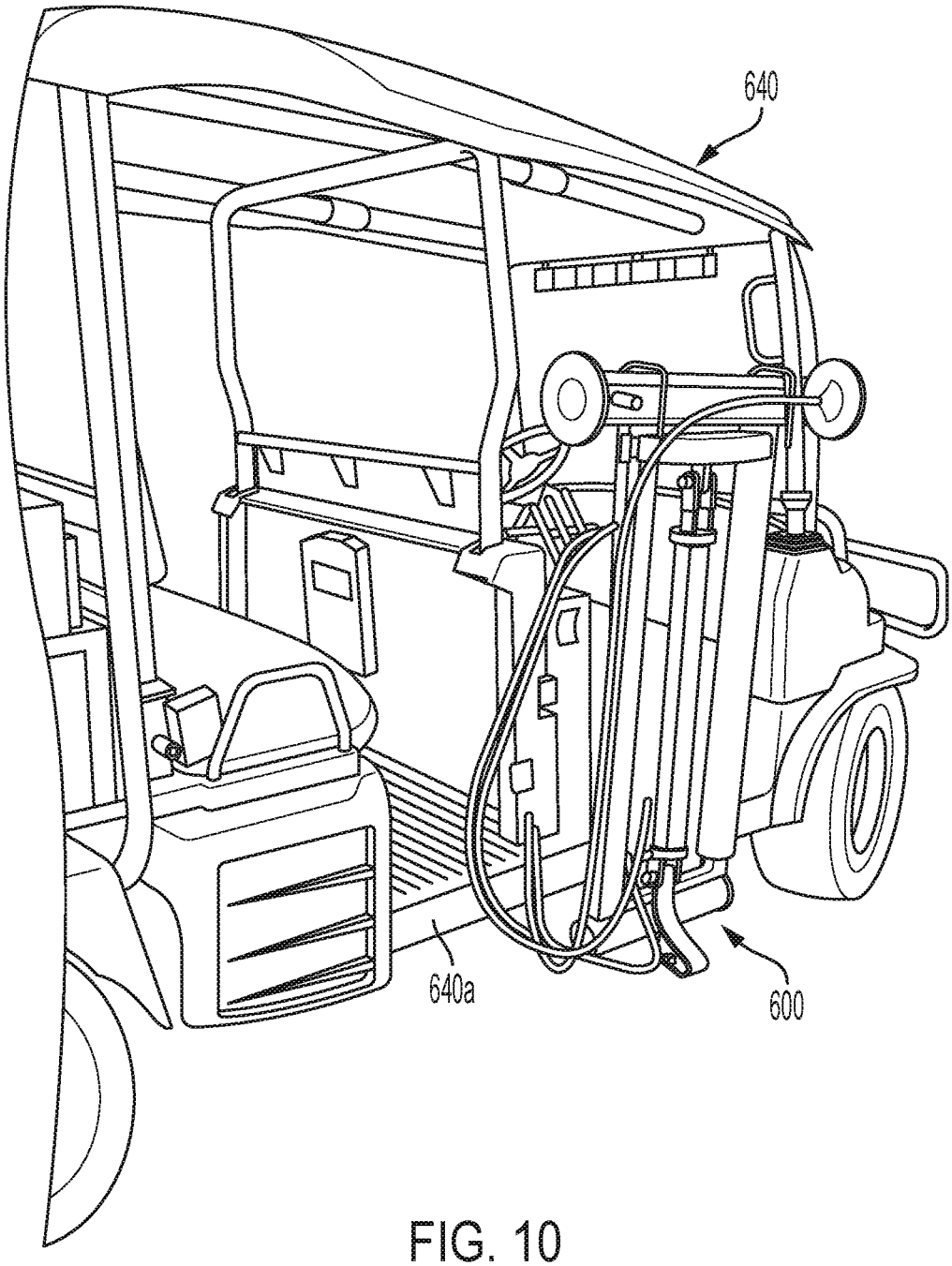
FIG. 10 is a perspective view of the railcar spacing tool of FIGS. 5-9 attached to the frame of a utility vehicle, with its boom in the retracted (substantially vertical) position.

An opposing lower end of the inner frame 605*a* has a pair of pins 635 for attaching the boom 605 to the chassis frame 640*a* of a conventional utility or service vehicle 640, such as available from Kubota Tractor Corporation, as shown in FIG. 10. The boom 605 is pivotably attached to the chassis 640*a* of the utility vehicle 640 via the pins 635, and a third hydraulic cylinder 645 is operatively attached between the vehicle chassis 640*a* and a link 650 rigidly attached to the lower end of the inner frame 605*a*. The link 650 and the third hydraulic cylinder 645 are arranged such that operation of the third hydraulic cylinder 645 pivots the boom 605 between a substantially vertical retracted position shown in FIGS. 5-7 and 10, to a substantially horizontal extended position shown in FIG. 9 where the boom 605 can be inserted between adjacent railcars to be spaced, in a position similar to that shown FIG. 3. Insertion of boom 605 between railcars is facilitated by the adjustability of its length between the first length $L_1$ shown in FIG. 6 and second length $L_2$ shown n FIG. 9. A conventional hydraulic pump (not shown) is carried by the utility vehicle 640 and connected to the three hydraulic cylinders 610, 615, 645 by conventional hoses (not shown) and conventional control valves 655 to operate the cylinders. In the illustrated embodiment of FIGS. 5-10, the control valves 655 are mounted on a stationary vertical frame 660 to ensure safe operation of the spacing tool 600.

Figure 11A:
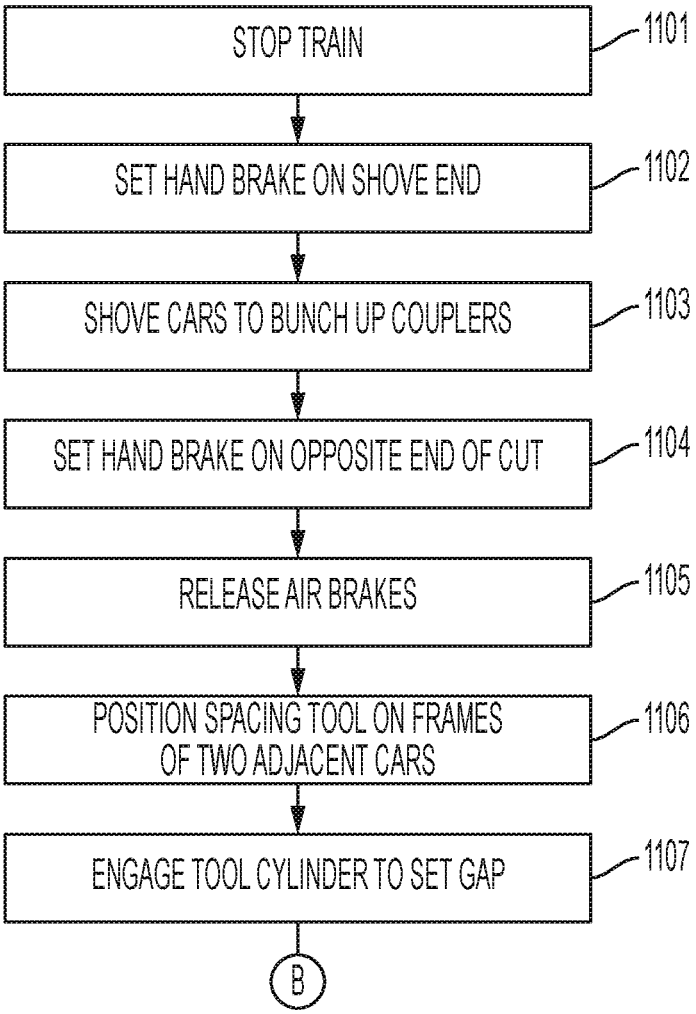
FIGS. 11*a-b* is a flow chart of a method using the disclosed railcar spacing tools.
Figure 11B:
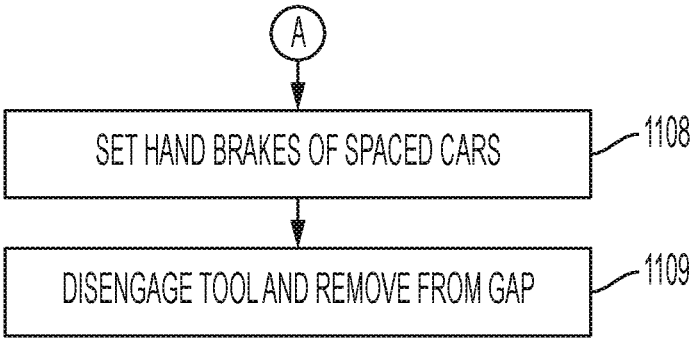

A procedure for using the disclosed railcar spacing tool for spacing two or more adjacent adjoined railcars apart from each other a predetermined distance will now be described with reference to the flow chart of FIGS. 11*a-b*. First, the train crew makes a 50' safety stop (step 1101), and fully applies the hand brake on a shove end of the cut of cars (i.e., on the end car of a plurality of adjoined adjacent cars) to be spaced by the tool at step 1102, to immobilize the end car. Then, the cars are shoved (i.e., moved toward the end car) to bunch up the couplers (a.k.a. knuckles) between cars at step 1103, so that they are positioned with a distance between their respective frames less than or equal to the predetermined distance. Once the cars are so compressed, the hand brake on the opposite end of the cut is fully set at step 1104, thereby capturing the bunch (i.e., preserving the compression of the cars). This bunching process is repeated as needed, after moving past the next spot a predetermined amount, such as 50'.

After ensuring the hand brakes are set on both ends of the cut of cars to be spaced, the cars' air brakes are released at step 1105 (i.e., by releasing the air in the cars' brake cylinders), and the spacing process is begun. At step 1106, the spacing tool is positioned on the frames of two adjacent railcars (e.g., about 2' to 4' from the ground) starting at the compressed end of the cut of cars. The tool 100 of FIGS. 1-4 is positioned as shown in FIG. 3 by placing the utility vehicle 140 an appropriate distance from the junction of the railcars 150 to be spaced, and lowering the boom 105 manually until the brackets 125, 130 are adequately lined up with the frames 150*a* of the cars 150. The tool 600 of FIGS. 5-10 is similarly positioned by lowering the boom 605 using the hydraulic cylinder 645, and extending it as needed (i.e., from length $L_1$ to length $L_2$ or between) using the hydraulic cylinder 610, until the brackets 625, 630 are adequately lined up with the frames of the cars.

After the tool 100, 600 is positioned, it is engaged to set the predetermined gap using the respective hydraulic cylinder 115 or 615 (step 1107). For example, the maximum gap is 42 inches when the hydraulic cylinder 115 or 615 is fully extended. Once the desired spacing has been achieved, the hand brakes of the cars that have been spaced are fully engaged (step 1108). Thereafter the spacing tool 100, 600 is disengaged at step 1109, thereby ensuring the proper gap is captured. The spacing tool is removed by reversing the pressure on the hydraulic cylinder 115, 615, and the tool is moved to the next junction where the process is repeated.

The disclosed spacing tool produces a safer work environment by removing the need for workers to position themselves between railcars during the bunching process. It improves efficiency by enabling train crews to make fewer spots, thereby increasing productivity and timelines throughout the industry. Further, it aligns automotive railcars as required by AAR standards to achieve perfect spacing.

While this disclosure has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this disclosure.

What is claimed is:

1. A railcar spacing tool in combination with a pair of adjacent adjoined railcars apart from each other a predetermined distance, the spacing tool comprising:

a cylinder having a body, a piston extendible from the body, a first bracket attached to a distal end of the body, and a second bracket attached to a distal end of the piston, the piston being extendible from the body such that a total length of the cylinder is adjustable from less than the predetermined distance to the predetermined distance, the first and second brackets being for contacting respective frames of the adjoined adjacent railcars to be spaced from each other;

wherein when the piston is extended from the body such that the total length is less than the predetermined distance and the first and second brackets are disposed between the respective frames of the adjacent railcars, the cylinder is for extending the piston until the first and second brackets contact the respective frames of the adjoined adjacent railcars, and for further extending the piston to move the adjacent railcars relative to each other until the total length of the cylinder is the predetermined distance;

the railcar spacing tool further comprising a cylinder support frame having a first end attachable to the body of the cylinder, and a second end movably attachable to a support vehicle such that the cylinder support frame is movable from a retracted position where the first end is proximal the support vehicle, to an extended position where the first and second brackets are disposed between the respective frames of the pair of adjoined adjacent railcars.

2. The railcar spacing tool of claim 1, wherein the cylinder is a hydraulic cylinder.

3. The railcar spacing tool of claim 1, wherein the second end of the cylinder support frame includes a plurality of pins for pivotably attaching the cylinder support frame to the support vehicle.

4. The railcar spacing tool of claim 3, further comprising a spring for biasing the cylinder support frame to the retracted position.

5. The railcar spacing tool of claim 3, wherein the retracted position of the cylinder support frame is a substantially vertical position, and the extended position of the cylinder support frame is a substantially horizontal position.

6. The railcar spacing tool of claim 3, comprising a second cylinder having a second body and a second piston extendible from the second body, the second body and second piston being operably connected between the cylinder support frame and the support vehicle to move the cylinder support frame between the retracted and the extended positions.

7. The railcar spacing tool of claim 6, wherein the second cylinder is a hydraulic cylinder.

8. The railcar spacing tool of claim 1, wherein a length of the cylinder support frame between the first and second ends is adjustable between a first length and a second length when the cylinder support frame is in the extended position.

9. The railcar spacing tool of claim 8, wherein the cylinder support frame comprises an inner frame and an outer frame slidably mounted over the inner frame to adjust the length of the cylinder support frame between the first length and the second length.

10. The railcar spacing tool of claim 9, comprising a third cylinder having a third body and a third piston extendible from the third body, the third body and third piston being operably connected between the inner frame and the outer frame to adjust the length of the cylinder support frame between the first length and the second length.

11. The railcar spacing tool of claim 10, wherein the third cylinder is a hydraulic cylinder.

12. A method for spacing a pair of adjacent adjoined railcars apart from each other a predetermined distance, the method comprising:

providing a spacing tool including a cylinder having a body, a piston extendible from the body, a first bracket attached to a distal end of the body, and a second bracket attached to a distal end of the piston, the piston being extendible from the body such that a total length of the cylinder is adjustable from less than the predetermined distance to the predetermined distance, the first and second brackets being for contacting respective frames of the pair of adjoined adjacent railcars to be spaced from each other;

positioning the pair of adjoined adjacent railcars such that a distance between their respective frames is less than or equal to the predetermined distance;

positioning the spacing tool such that the first and second brackets are disposed between and contact the respective frames of the pair of adjoined adjacent railcars;

extending the piston from the body of the cylinder as needed to move the adjacent railcars relative to each other until the total length of the cylinder is the predetermined distance, thereby spacing the respective frames of the pair of adjoined adjacent railcars from each other by the predetermined distance;

applying brakes of the pair of adjoined adjacent railcars to preserve the spacing between the railcars; and removing the spacing tool from between the respective frames of the pair of adjoined adjacent railcars.

13. The method of claim 12, wherein the pair of adjacent adjoined railcars are two railcars of a cut of a plurality of adjacent adjoined railcars, and the step of positioning the pair of adjoined adjacent railcars comprises:

applying a hand brake of a first end railcar of the cut of railcars to immobilize the first end railcar;

moving the cut of railcars towards the first end railcar to bunch up respective couplers of the cut of railcars such that the distance between the respective frames of the pair of adjacent adjoined railcars is less than or equal to the predetermined distance; and applying a hand brake of a second end railcar of the cut of railcars to immobilize the second end railcar.

14. The method of claim 12, comprising providing a cylinder support frame having a first end attachable to the body of the cylinder of the spacing tool, and a second end movably attachable to a support vehicle such that the cylinder support frame is movable from a retracted position where the first end is proximal the support vehicle, to an extended position where the first and second brackets are disposed between the respective frames of the adjacent railcars;

wherein positioning the spacing tool comprises locating the support vehicle relative to the pair of adjoined adjacent railcars such that the cylinder support frame is movable to the extended position, and subsequently moving the cylinder support frame to the extended position.

15. The method of claim 12, wherein the cylinder is a hydraulic cylinder.

16. The method of claim 12, wherein the spacing tool further includes a second cylinder having a second body and a second piston extendible from the second body, the second body and second piston being operably connected between the cylinder support frame and the support vehicle to move the cylinder support frame between the retracted and the extended positions.

17. The method of claim 16, wherein the second cylinder is a hydraulic cylinder.

* * * * *